US005415396A

United States Patent [19]

Huang

[11] Patent Number: 5,415,396

[45] Date of Patent: May 16, 1995

[54] BASEBALL BATTER PRACTICE MACHINE

[76] Inventor: Hui C. Huang, P.O. Box 96-173, Taipei, Taiwan, Prov. of China

[21] Appl. No.: 149,849

[22] Filed: Nov. 10, 1993

[51] Int. Cl.[6] ..... A63B 69/40

[52] U.S. Cl. ..... 273/26 E

[58] Field of Search ..... 273/26 E, 29 A, 200 R, 273/58 C

[56] References Cited

U.S. PATENT DOCUMENTS

| | | | |
|---|---|---|---|
| 3,547,437 | 12/1970 | Anderson | 273/26 E |
| 3,626,502 | 12/1971 | Weil | 273/26 E |
| 4,609,197 | 9/1986 | Vodin | 273/200 R |
| 4,815,735 | 3/1989 | McClenny | 273/26 E |
| 4,993,708 | 2/1991 | Prosser | 273/26 R |

*Primary Examiner*—Theatrice Brown
*Attorney, Agent, or Firm*—McGlew and Tuttle

[57] ABSTRACT

The present invention is a baseball batter practice machine, which offers a convenient, disassemble and assemble easy unit for batter practice. In general, it is composed of a ball, an adjustable plastic shaft, a supporting sleeve, a sleeve setter, two supporting boards, and a base. The ball is designed with connecting line, assembled on top of the adjustable plastic shaft, and the connecting line goes all the way through the ball, adjustable plastic shaft, supporting sleeve, base, spring to adjustment screw, to allow the ball under the control of batter. The adjustable plastic shaft may cater to the batter's height. The supporting sleeve and sleeve setter is collapsible, so as the supporting boards may retrieve, in making the ball, adjustable plastics shaft, supporting sleeve, and bat of the present invention tie to the base with fasteners for easy storage and carrying. When in use, the unit can be easily assembled in a short time, to reach the effect of space saving, practice, easy storing, and easy carrying, all those conveniences.

1 Claim, 5 Drawing Sheets

BASEBALL BATTER PRACTICE MACHINE

FIELD OF THE INVENTION

The present invention relates to a baseball batter practice machine; especially a baseball batter practice machine which has a structure which is an easily disassembled and assembled unit.

BACKGROUND OF THE INVENTION

Baseball is an excellent sport. Due to the limited space available, practice is often impractical. As in golf, the limited space produces the birth of Golf Practice Machine. The baseball batter practice machine today is an electric controlled pitching device with a complicated mechanism, and expensive as well. The execution space has to be large to accommodate adults due to safety reasons. Not being fit for children is an obstacle for baseball promotion. Therefore, the present invention is to design a batter practice machine for disassemble and assemble with a simple structure, and easy to carry, all functions.

SUMMARY OF THE INVENTION

The present invention offers a connecting line between the ball and the unit, which make the ball easy collectible when hit. The unit is collapsible, and disassembles easy to reduce its bulk volume for easy carrying. It is a fast and easy assembled unit as well as efficient.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of tile invention are illustrated.

DESCRIPTION OF THE PREFERRED EMBODIMENTS

Figure 1:
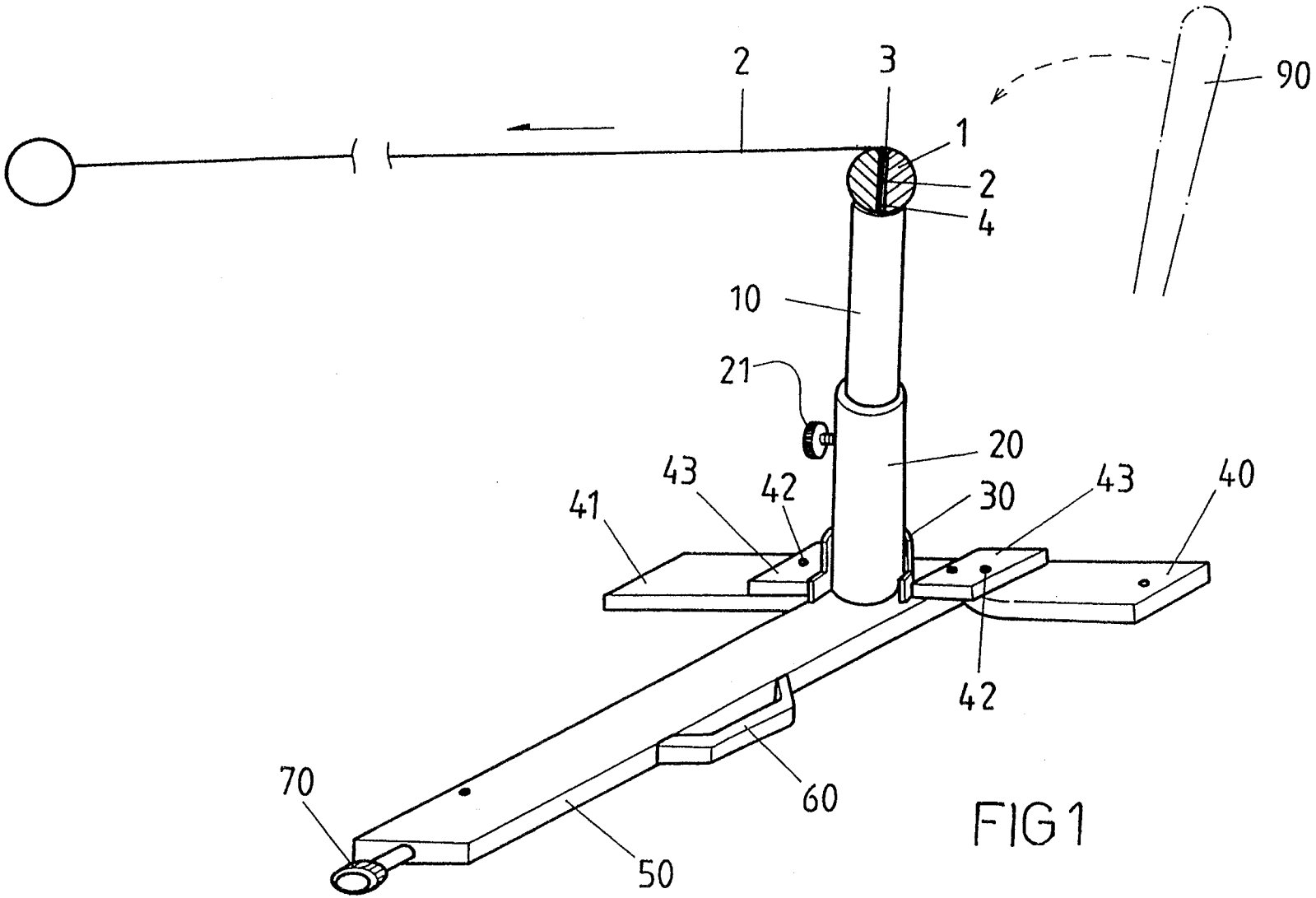
FIG. 1 is the perspective view of the present invention.

Referring to FIG. 1, the perspective view of the present invention includes major parts as a ball 1, adjustable plastic shaft 10, supporting sleeve 20, sleeve setter 30, supporting board 40, 41, and base 50.

There is a hole 4 which goes right through the center of the ball, and ends at a setting block 3. The setting block 3 is attached to a connecting line 2 which runs through the hole 4.

The adjustable plastic shaft 10 is made of soft, flexible plastic with a center hole 11 which the connecting line 2 passes through.

The supporting sleeve 20 is a hollow cylinder. Its coordinating sleeve setter 30 possesses a lock hole 32 (shown on FIG. 5) on the side. On top of the supporting sleeve, there is a shaft lock plug or screw which is connected to the supporting sleeve 20 and may go through the tip of the adjustable plastic shaft 10 to lock the supporting sleeve 20 to the plastic shaft 10.

The sleeve setter 30 is positioned on the base 50 as a semi-circular blocking wall; its coordinating supporting sleeve 20 has a coordinating lock hole 32 which matches a base lock plug or screw 31 on sleeve setter 30.

The base 50 is a long rectangular board with an indented seat 52 at one end to enhance the support of sleeve setter 30. Its interior is designed to define a hollow tube or passage 51 in which connecting line 2 and spring 80 joins, and the tension between spring 80 and connecting line 2 may be adjusted by manipulating adjustment screw 70 at the other end.

The supporting board 40, 41 are pivotally connected to connecting block 43 with an axle joint 42 to either side of the base 50; which then becomes collapsible through axle joint 42.

Figure 2:
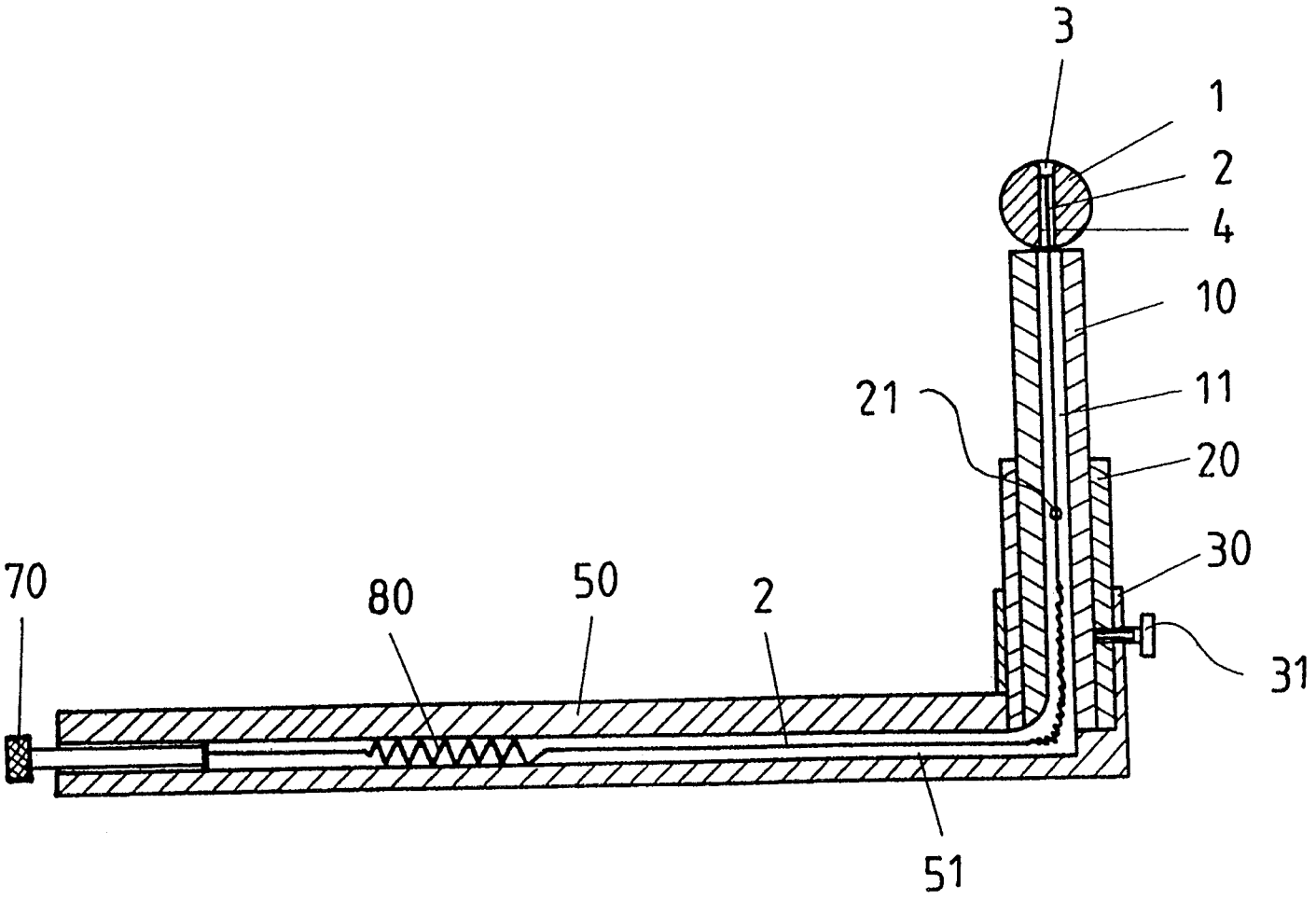
FIG. 2 is the diagrammatic view of the present invention.

Based on the above stated parts, the structure of the present invention (see FIG. 2) is to join the ball 1 with connecting line 2 through the center hole 11 of the adjustable plastic shaft 10, then through line hole 53 to enter the hollow tube 51 of the base 50 in order to connect with the spring 80. The spring 80 and the adjustment screw 70 assemble, then sets into the end of hollow tube 51, this allows the adjustment screw 70 to work. The adjustable plastic shaft 10 is placed into the supporting sleeve 20, and matched with the position of the lock plug 21 to lock it. The bottom of supporting sleeve 20 will set into the indented seat 52 of the base 50, and matched with the lock hole 32 and the lock plug 31 on the sleeve setter 30. This allows the supporting sleeve 20 to stand upright and lock with sleeve setter 30, finishing the assemble of the baseball batter practice machine.

Understanding the components, structure of the present invention, the operation, function of the present invention is stated as follows:

1. Operation and function

Figure 3:
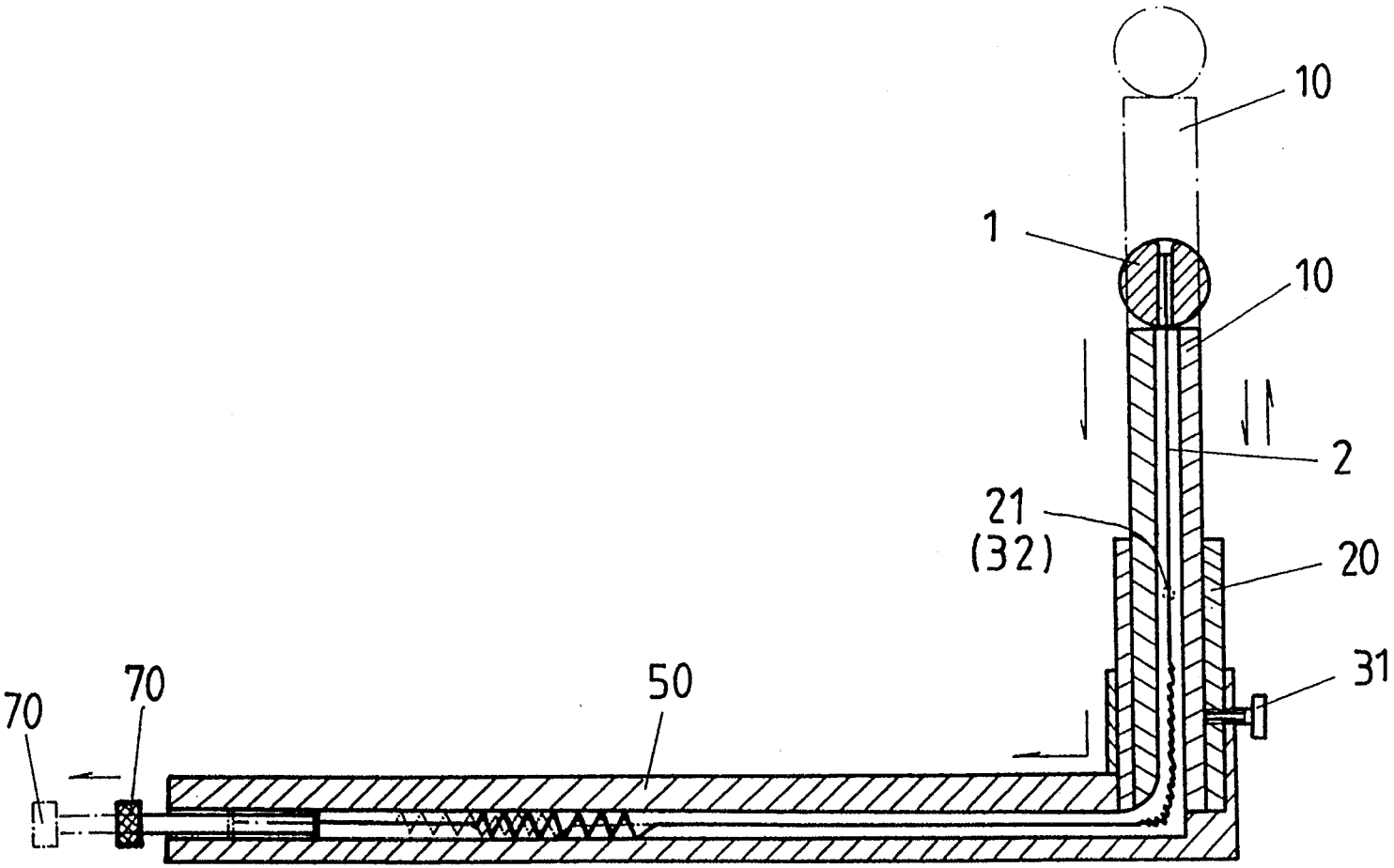
FIG. 3 is the diagrammatic view of the present invention in adjustment.

Please refer to FIG. 1 and 3. The present invention can adjust the ball 1 to cater to the batter's height, and adjust the spring tension to control the ball 1, depending on the batter's demand. By adjusting the adjustable plastic shaft 10, we can match the batter's height. Flexible plastic allows the adjustable plastic shaft to bend when hit by batter unintentionally. Of course, the baseball bat 91 will not be damaged, neither will the hands of the batter. Connecting line 2 joins to the ball 1, and as the ball 1 is hit, the ball is pulled by the connecting line 2 to retrieve the ball 1 for the next try. Through the altering of the adjustment screw 70, the position of the spring 80 may change the tension of the ball 1 when hit (tighten or loosen); and further control the speed of the ball 1, which means, we can adjust the speed of the ball 1 by the tension of the spring 80.

2. Collapsible to reduce the bulk volume

Figure 4:
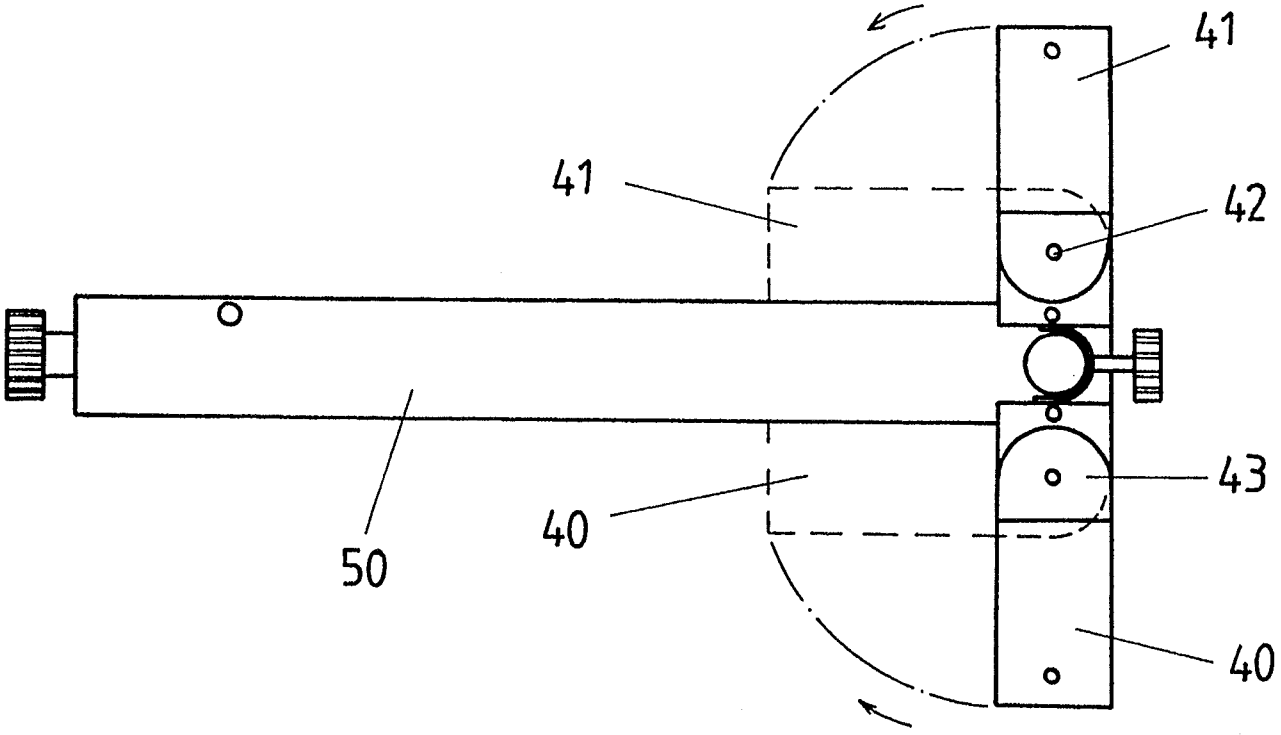
FIG. 4 is the supporting board of tile present invention collapsible instruction diagram.
Figure 5:
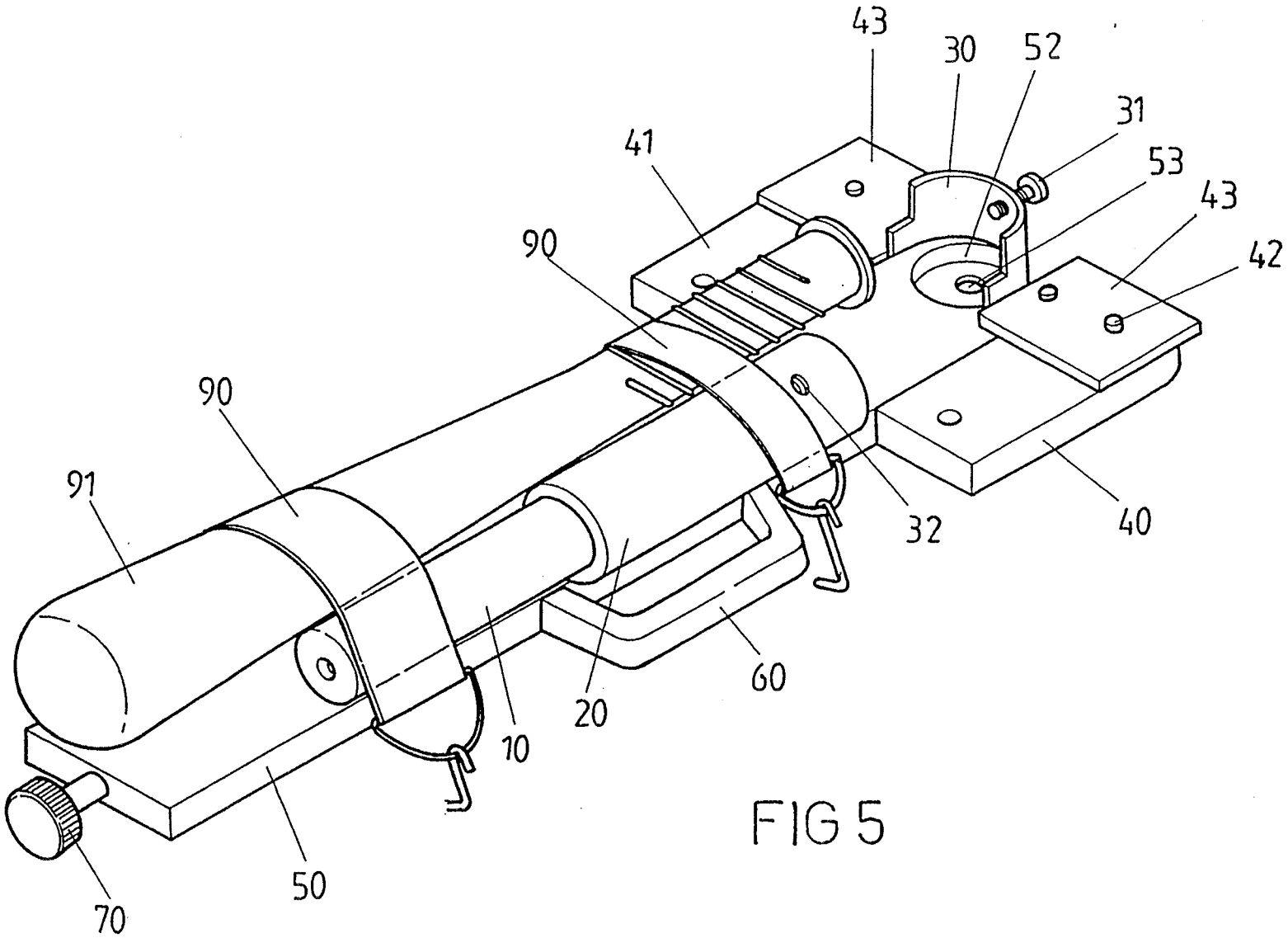
FIG. 5 is the collapsible instruction diagram of the present invention.

Please refer to FIG. 4 and 5. When not in use, the present invention is designed for convenient carrying and reduction in volume with collapsible foldable features. As shown in FIG. 4, the supporting boards 40 and 41 may extend to support the unit's balance. The axle joint 42 may allow the supporting boards 40, 41 to turn toward the base 50 to reduce storing surface. The adjustable plastic shaft 10, supporting sleeve 20 may be disassembled through the loosening of the lock plug 31. The bat 91 will sit on top of the base 50 comfortably. To tie it up with fasten band 90 will reduce the volume furthermore. The handle 60 attached to the base 50 will make the present invention easy to carry as well.

To sum it all, the present invention offers a baseball batter practice machine with the features of height adjustment, tension adjustment, assemble and disassemble easy, and changeable bulk volume for storage.

While specific embodiments of the invention have been shown and described in detail to illustrate the application of the principles of the invention, it will be understood that the invention may be embodied otherwise without departing from such principles.

What the claimed is:

1. A baseball batting practice apparatus comprising:

an elongated base having a substantially rectangular shape and a depression at one end thereof, said base having a cavity extending its entire length, said cavity being in communication with said depression and further being substantially perpendicular thereto;

first and second elongated support boards pivotally connected to said one end of said base at opposite sides of said base, said first and second support boards being pivotable between a position substantially perpendicular to said base and a position substantially parallel to said base;

a support sleeve having a first end positioned in said depression and extending upward from said base, said support sleeve having a first aperture extending through its wall;

a sleeve setter having a substantially half-circle shaped wall and being substantially co-axial with said support sleeve, said sleeve setter having a second aperture, said first and second apertures being aligned when said first end of said support sleeve is positioned in said depression; means insertable into said first and second apertures for fastening said support sleeve to said sleeve setter;

a ball support shaft, said support shaft being adjustably inserted into said support sleeve, said shaft having a cavity extending its entire length and in communication with said cavity in said base;

a threaded bolt extending through the wall of said support sleeve to thereby lock said support shaft at a predetermined elevation relative to said base;

a ball positionable on said ball support shaft;

a connecting line having one end attached to said ball, said connecting line extending from said ball, through said cavity of said ball support shaft and through said cavity in said base;

an elongated spring means positioned in said cavity of said base, said line having its other end attached to one end of said spring means;

adjustment screw means attached to the other end of said spring means for adjusting tension in said spring means and said connecting line, thus adjusting the speed of which a ball will return to said ball support shaft.

* * * * *